US005611187A

United States Patent [19]

Jones

[11] Patent Number: 5,611,187

[45] Date of Patent: Mar. 18, 1997

[54] CONSTRUCTION SYSTEM

[76] Inventor: Richard H. Jones, 2709 Fleming St., Alexandria, Va. 22306-1625

[21] Appl. No.: 418,429

[22] Filed: Apr. 7, 1995

Related U.S. Application Data

[63] Continuation-in-part of Ser. No. 203,572, Mar. 1, 1994, Pat. No. 5,430,989.

[51] Int. Cl.[6] ..... E04C 3/02

[52] U.S. Cl. ..... 52/646; 52/81.3; 52/648.1; 52/652.1; 52/653.1; 52/655.1; 52/656.9; 52/657; 52/DIG. 10; 403/122; 403/126; 446/122; 446/126

[58] Field of Search ..... 52/81.1, 81.3, 52/648.1, 652.1, 653.1, 655.1, 655.2, 646, 656.9, 657, DIG. 10; 446/122, 126; 135/115, 119, 93, 97; 403/171, 176, 217

[56] References Cited

U.S. PATENT DOCUMENTS

| | | |
|---|---|---|
| 1,113,371 | 10/1914 | Pajeau . |
| 1,198,263 | 9/1916 | Pajeau . |
| 1,915,835 | 6/1933 | Pajeau . |
| 2,682,235 | 6/1954 | Fuller . |
| 2,986,241 | 5/1961 | Fuller . |
| 3,521,421 | 7/1970 | Schroeder, Jr. . |
| 3,974,600 | 8/1976 | Pearce . |
| 4,065,220 | 12/1977 | Ruga . |
| 4,136,984 | 1/1979 | Hayashi . |
| 4,521,998 | 6/1985 | Delorme . |
| 4,580,922 | 4/1986 | Coppa . |
| 4,650,361 | 3/1987 | Seuster . |
| 4,904,108 | 2/1990 | Wendel . |
| 4,982,546 | 1/1991 | Lange . |
| 5,049,105 | 9/1991 | Glickman . |
| 5,127,759 | 7/1992 | Orbom . |
| 5,155,951 | 10/1992 | Lalvani . |
| 5,161,344 | 11/1992 | Kahonen . |

FOREIGN PATENT DOCUMENTS

| | | |
|---|---|---|
| 1372340 | 8/1965 | France . |
| 617011 | 8/1935 | Germany . |
| 589940 | 3/1958 | Italy . |
| 893983 | 4/1962 | United Kingdom . |
| 2244536 | 12/1991 | United Kingdom . |

*Primary Examiner*—Christopher T. Kent
*Attorney, Agent, or Firm*—Everett G. Diederiks, Jr.

[57] ABSTRACT

A construction system for making latticework structures comprising connectors and rods. Each connector has a base portion with at least two side portions and opposing faces. A first attaching element is attached to a first side portion of the base portion. Second and third attaching elements are secured in axial alignment at spaced locations to a second side portion of the base portion. Respective connectors can be interconnected to each other by placing the first attaching element of one connector between the second and third axially aligned attaching elements of another connector and passing a rod through aligned receiving openings in each of the first, second and third attaching elements. Many of these connectors and rods may be assembled to form larger structures such as cubes, pyramids and other polyhedrons. The connectors themselves may take various shapes such as triangles, sectors and trapezoids. Several embodiments are described for retaining the rods in the connectors and for attaching a face forming structure to the resulting structures.

13 Claims, 12 Drawing Sheets

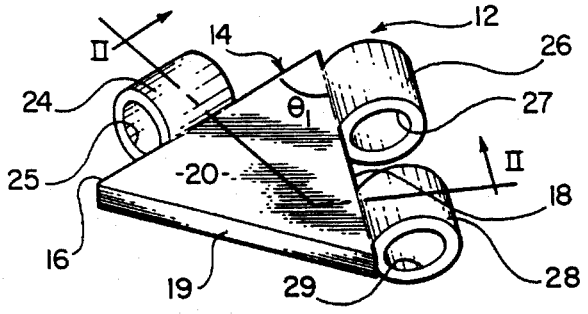
FIG. 1
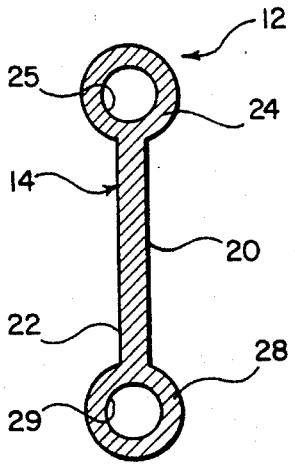
FIG. 2
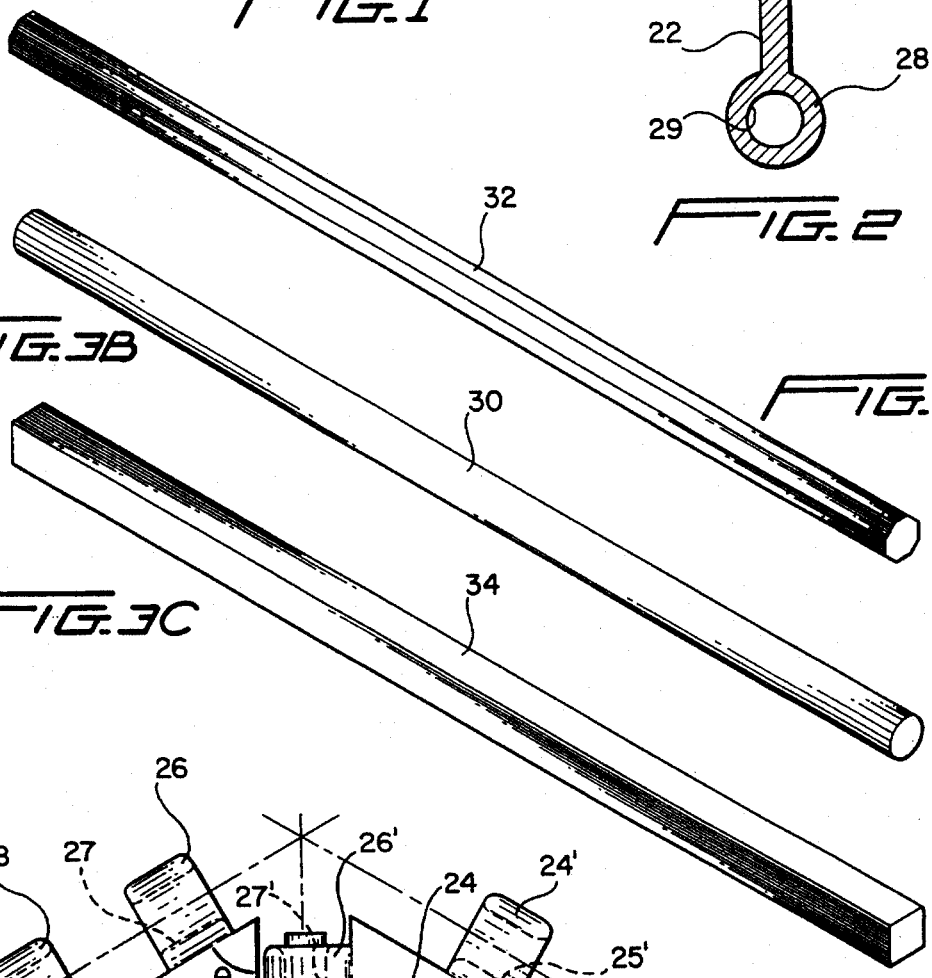
FIG. 3B
FIG. 3A
FIG. 3C
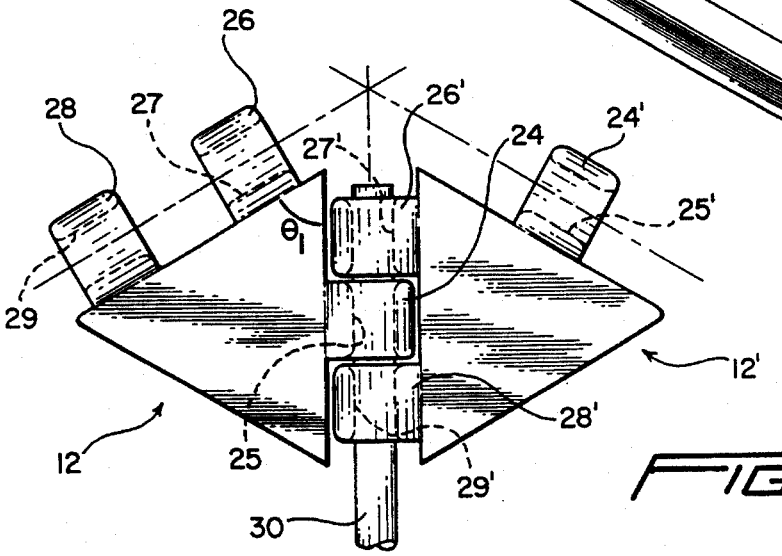
FIG. 4

FIG. 20
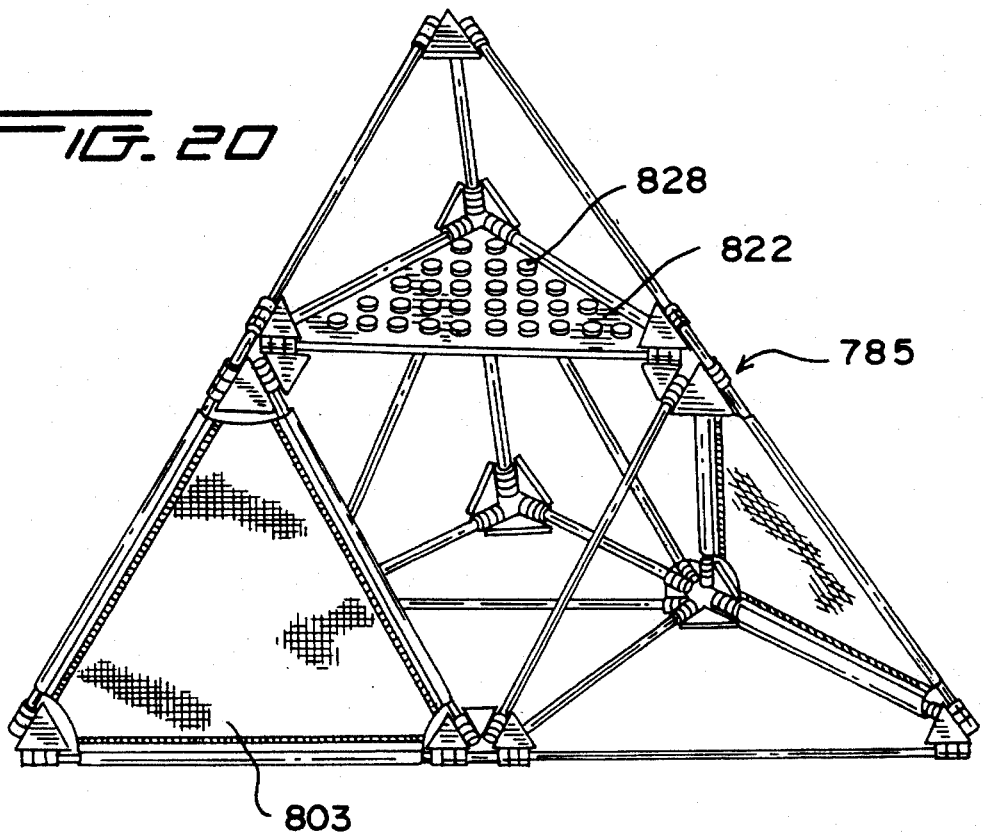
FIG. 21A
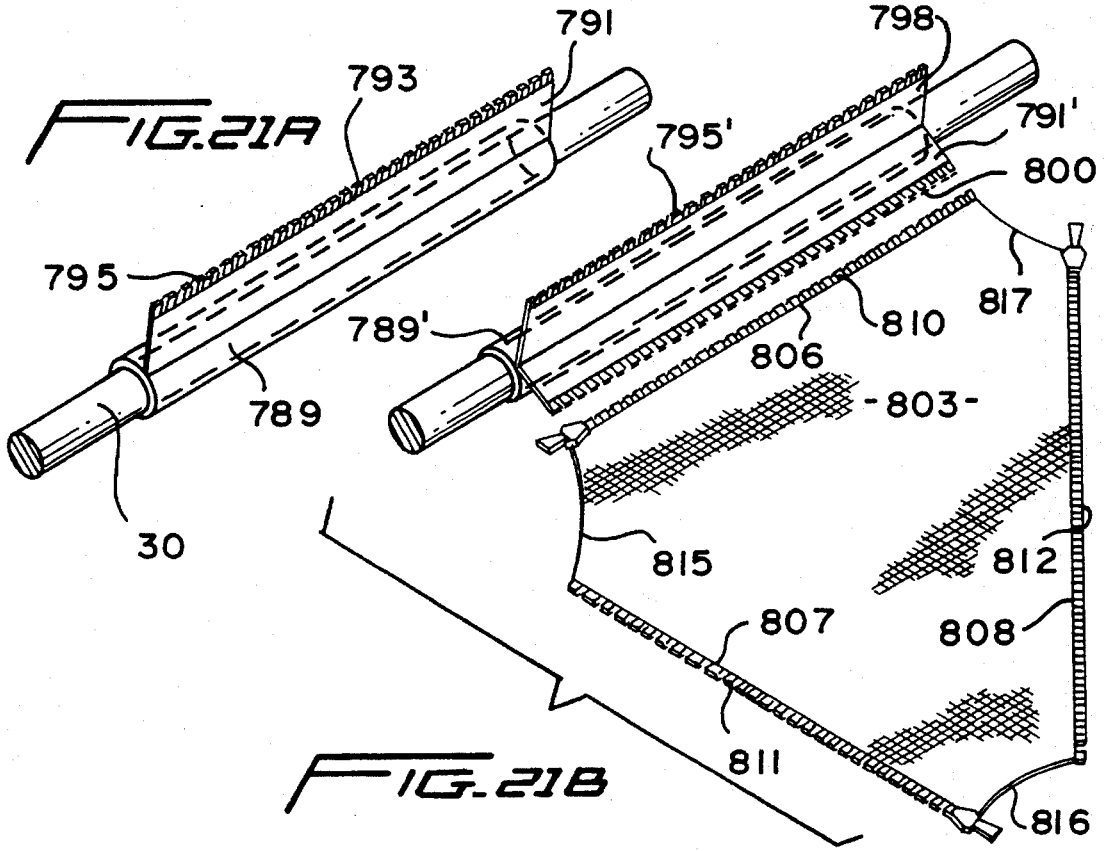
FIG. 21B

CONSTRUCTION SYSTEM

This application is a continuation-in-part of application Ser. No. 08/203,572 filed Mar. 1, 1994, now U.S. Pat. No. 5,430,989.

BACKGROUND OF THE INVENTION

1. Field of the Invention

The present invention generally pertains to the art of construction systems and, more particularly, to a construction system constituted by connectors and rods which can be interconnected to form various latticework structures.

2. Discussion of Prior Art

Construction systems using rods and connectors to form latticework structures are generally known in the prior art. These structures are generally created by interconnecting the ends of elongated rods to form a rigid frame. Examples of such structures include oil derricks, antenna towers, bridges and tressels.

Much of the prior art describes the methodology of constructing buildings. For example, U.S. Pat. No. 2,682,235 to Fuller discloses a geodesic dome formed from a number of struts which are interconnected by connectors. These struts and connectors are assembled into triangles which are then interconnected to form the dome. U.S. Pat. No. 2,986,241 discloses a building made using a strut and connector construction system. U.S. Pat. Nos. 3,974,600 and 5,155,951 describe how special classes of framework elements can be used to create certain types of building structures. In essence, these patents disclose using rods and connectors to make modular frame units such as triangles or polyhedrons. These modular shapes are then combined to form an overall building. Unfortunately, none of these patents disclose an inexpensive way of connecting the rods in a quick and efficient manner without the need for complex tools.

It is also known in the prior art to use connectors and rods to create toy construction sets. U.S. Pat. Nos. 1,113,371, 1,198,263 and 1,915,835 to Pajeau and U.S. Pat. No. 5,049,105 to Glickman exemplify such toy construction sets. It will be noted from observing the aforementioned patents that these patents disclose construction systems in which rod members are connected to and extend radially outward from a hub. They are limited in that all the connecting rods except one must be in a single plane. These construction sets therefore have limited application.

Several prior art patents disclose the specific structure of joining a hub to a rod. In general, these patents describe connector and rod assemblies which can be used to make many of the structures discussed above. However, it should be noted that the combination of a high degree of specialization, the relatively complex design and the difficulty of fabricating these patented connectors has evidently mitigated against their commercial success. For example, U.S. Pat. No. 4,521,998 discloses a universal hub specifically designed for geodesic type structures. U.S. Pat. No. 4,650,361 discloses a joint specifically adapted to attach reflector panels to a truss support structure of a radio telescope. U.S. Pat. Nos. 4,065,220 and 4,904,108 each disclose connectors for a construction system which are rather complex in shape and require the machining of numerous sockets at angles carefully calculated in three dimensions. Obviously, these factors add great expense in the overall manufacturing of these connectors.

U.S. Pat. Nos. 3,521,421 and 4,136,948 each disclose connectors for joining tubular members. It should be noted that while U.S. Pat. No. 3,521,421 does disclose an adjustable connector which can create a lattice, this patent does not disclose a system in which it is possible to combine several connectors to form a single rigid joint. In addition, three or more connectors of the art disclosed in U.S. Pat. No. 3,521,421 can be combined with one another in a single joint only when adjusted identically. This severely limits the possible applications of the connectors. The connection arrangement in U.S. Pat. No. 4,136,984 suffers from a similar problem. Actually, it is not possible to combine two or more of the connectors disclosed in U.S. Pat. No. 4,136,984 to form a single rigid joint. Rather, this prior art patent teaches providing a rigid, integrally formed connector for each joint that is desired. Creating a separate, rigid and integrally formed connector for each joint unduly adds to the expense associated with such a system.

Based on the above discussion, it should be readily apparent that there exists a need in the art for a construction system composed of a relatively few number of connector pieces that can be inexpensively manufactured and yet can be interconnected to form a wide variety of latticework structures.

SUMMARY OF THE INVENTION

It is an object of the present invention to provide a construction system made up of a collection of extremely simple connector elements which can be fabricated inexpensively but which can be easily interconnected by rods in order to form various latticework structures.

It is another object of the invention to provide a construction system comprised of connector elements from a relatively small set of sizes that can be interconnected by means of rods in a variety of ways so as to create a wide range of complex joints for latticework structures.

These and other objects of this invention are realized by providing a construction system made up of a plurality of varying sized connectors that are adapted to be interconnected by rods. Each of the connectors comprises a base portion having opposing faces and various side portions. Attaching elements of preferably cylindrical cross-section are mounted on respective side portions of the base portion. Each of the attaching elements defines a receiving opening that has an associated longitudinal axis. The longitudinal axes of the various receiving openings converge to a point spaced from the base portion. The rods may be inserted into the receiving openings of aligned attaching elements thus forming a joint. Several of these connectors and rods can be interconnected to form relatively large structures.

Other objects, features and advantages of the invention shall become more readily apparent from the following detailed description of a preferred embodiment thereof, when taken in conjunction with the drawings wherein like reference characters refer to corresponding parts in the several views.

BRIEF DESCRIPTION OF THE DRAWINGS

FIG. 1 is a perspective view of a first connector embodiment incorporated in the construction system of the present invention;

FIG. 2 is a cross-sectional view generally taken along line II—II of FIG. 1;

FIGS. 3A through 3C show perspective views of connecting rods of varying cross-sections usable in the construction system of the invention;

FIG. 4 is a plan view of two connectors, constructed in the manner shown in FIG. 1, assembled together with a connecting rod;

FIG. 20 illustrates a latticework structure that can be constructed in accordance with the present invention;

FIG. 21A illustrates a manner in which a cover or face member can be attached to a latticework structure constructed in accordance with the present invention;

FIG. 21B illustrates a modified version of the cover or face attaching arrangement illustrated in FIG. 21A along with an exemplary cover member;

DETAILED DESCRIPTION OF THE PREFERRED EMBODIMENTS

Figure 5A:
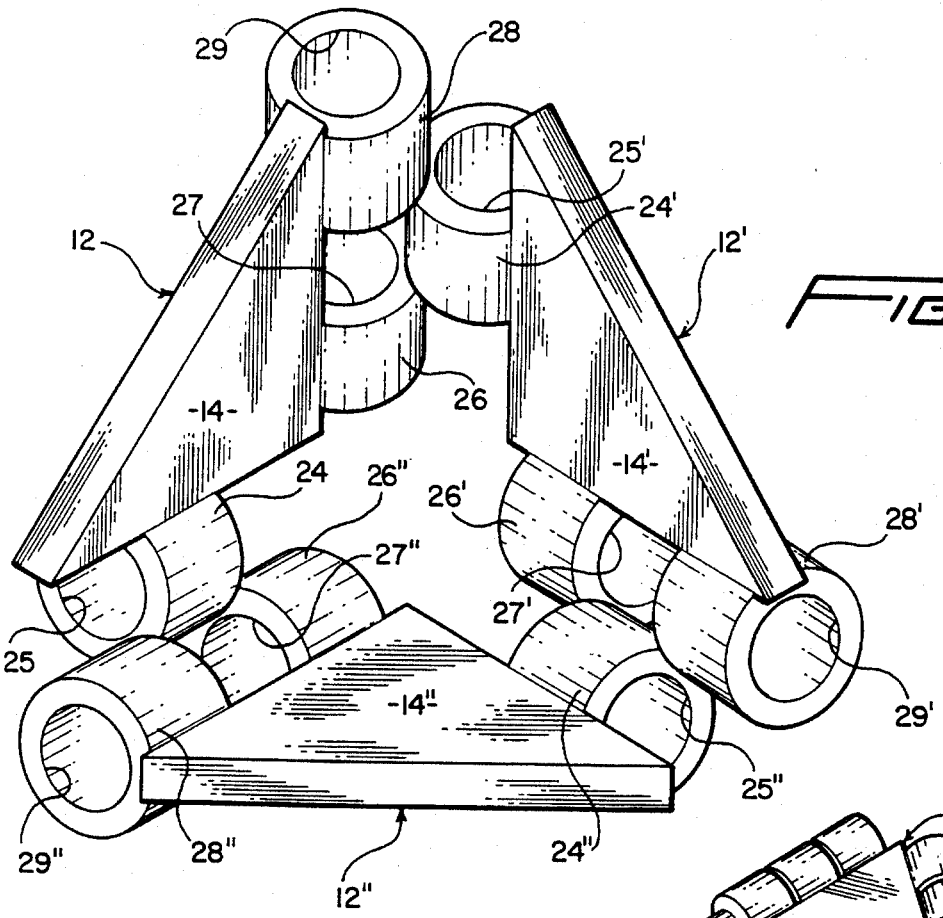
FIG. 5A is an exploded perspective view of three partially assembled, interlocking connector constructed in a manner illustrated in FIGS. 1 and 2.

With initial reference to FIGS. 1 and 2, a first connector incorporated in the construction system of the present invention is generally indicated at 12. Connector 12 comprises a base portion 14 having a first side portion 16, a second side portion 18 and a third side portion 19. In the preferred embodiment of connector 12, first and second side portions 16 and 18 converge to define an angle $\theta_1$ equalling 60°. In addition, base portion 14 has opposing faces 20 and 22 as can best be seen in FIG. 2. A first attaching element 24 is attached to the first side portion 16 of the base member 14. In the preferred embodiment, attaching element 24 constitutes a tubular member having a receiving opening 25. A second attaching element 26, having a receiving opening 27, and a third attaching element 28, having an associated receiving opening 29, are attached to the second side portion 18 of base portion 14. In the preferred embodiment shown, attaching elements 26 and 28 also constitute tubular members. Attaching elements 26 and 28 are axially aligned and, as discussed more fully below, are spaced a distance slightly greater than the length of attaching element 24.

As depicted, receiving openings 25, 27 and 29 are circular in cross-section so as to accommodate a circular rod such as that indicated at 30 in FIG. 3B. However, it should be understood that the specific geometry of receiving openings 25, 27 and 29, as well as attaching elements 24, 26 and 28 themselves, can be varied without departing from the spirit of the invention. For instance, these geometries could be such so as to accommodate various shaped rods such as those shown in FIGS. 3A–3C. For instance, a rod 32 with an octagon-shaped cross-section as shown in FIG. 3A or a rod 34 with a square cross-section as shown in FIG. 3C could be used. However, it should be noted, as will be more fully discussed below, that utilizing cylindrical rod 30 permits relative pivoting between multiple assembled connectors 12.

FIG. 4 depicts two connectors constructed in the manner shown in FIG. 1 assembled with a rod. More specifically, first connector 12 is interconnected with a second connector 12' by means of rod 30. Since second connector 12' is constructed identical to connector 12, a detailed description of its construction need not be repeated here. Instead, the same reference numerals utilized in detailing the construction of connector 12 have been utilized is referencing corresponding parts of connector 12' with the inclusion of a prime.

To interconnect connectors 12 and 12', attaching element 24 of connector 12 is positioned between attaching elements 26' and 28' of connector 12' such that their respective receiving openings 25, 27' and 29' are axially aligned and rod 30 extends therethrough. In the preferred embodiment, attaching element 24 of connector 12 is adapted to fit snugly between attaching elements 26' and 28' such that connectors 12 and 12' are prevented from sliding axially relative to each other. In addition, receiving openings 25, 27' and 29' have associated diameters which are only slightly greater than the diameter of rod 30 to prevent undesirable play in the joint created between connectors 12 and 12'. It should also be noted that the point at which the longitudinal axis defined by aligned receiving openings 27 and 29 intersects the longitudinal axis defined by receiving openings 25, 27' and 29' is coincident with the point of intersection of the longitudinal axis defined by receiving opening 25' and receiving openings 25, 27' and 29'. Connectors which satisfy this intersecting axes relationship can be readily interconnected to create a wide range of complex joints for latticework structures as will be emphasized more fully below. On the other hand, connectors whose axes fail to intersect in a single point, or zone depending upon allowable tolerances, can obviously not be combined to form a joint for connecting together a plurality of rods having a single converging vertex. Therefore, when utilizing a variety of differently sized connectors in accordance with the present invention, the physical dimensions of the connectors are preferably chosen so that they all satisfy this intersecting axes relationship. This greatly contributes to the versatility of the present construction system.

Figure 5B:
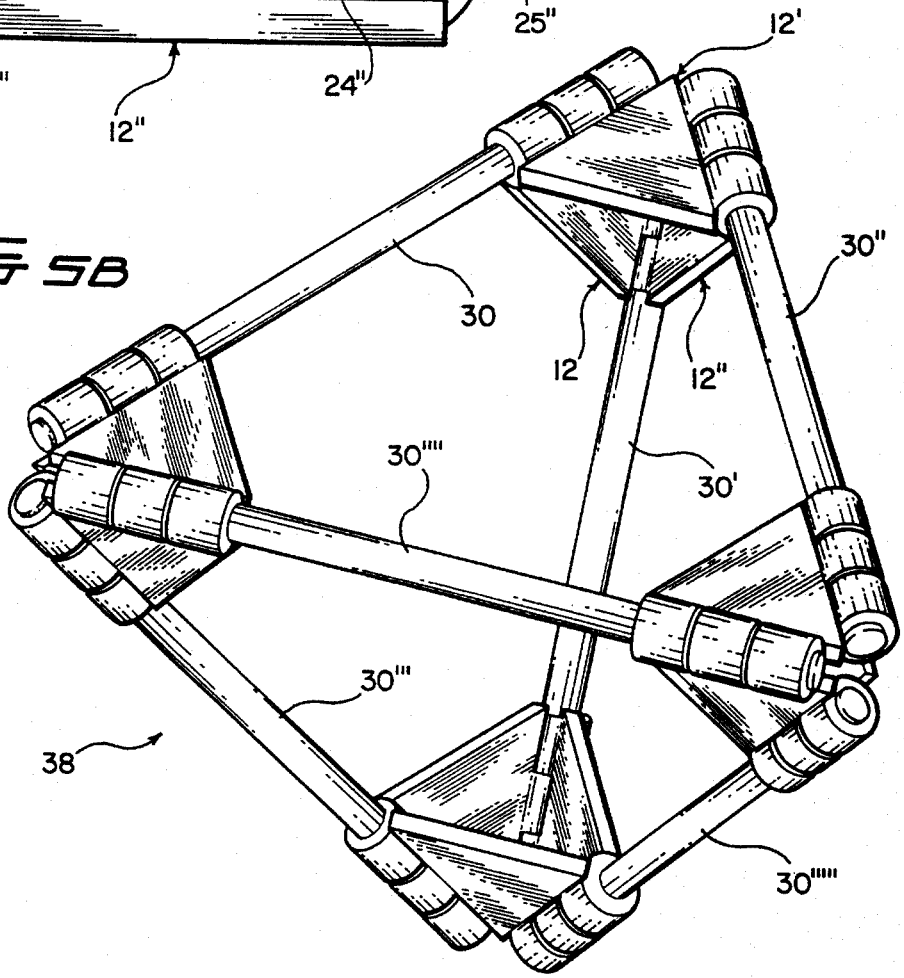
FIG. 5B depicts a perspective view of a tetrahedron constructed using the rods and connectors of FIGS. 1–5A.

Now referring to FIG. 5A, there is shown three connectors 12, 12' and 12" in the process of being assembled into a corner piece or joint. As shown, the corner piece is formed by aligning the respective receiving openings of attaching elements 26, 24' and 28; 26", 24 and 28"; and 26', 24" and 28'. These aligned receiving openings can each receive a respective rod 30 to form the corner piece. This corner piece, along with three other corner pieces of similar construction, can be interconnected by respective connecting rods 30, 30', 30", 30''', 30'''' and 30''''' in order to form the pyramid-shaped latticework structure 38 shown in FIG. 5B. Again, it should be noted that the group of rods 30, 30', and 30" define longitudinal axes that intersect at a vertex remote from connectors 12, 12' and 12". This holds true for the respective group of rods joined together at each corner joint.

Figure 6:
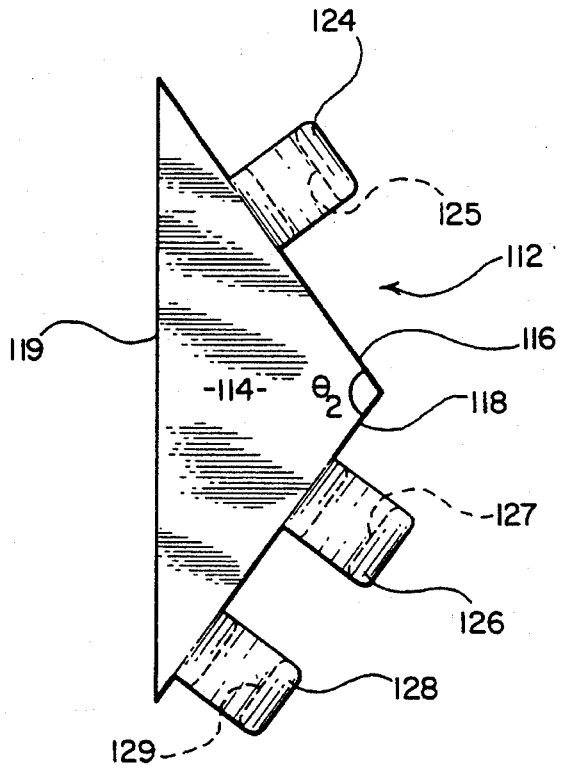
FIG. 6 is a plan view of a second connector embodiment incorporated in the construction system of the invention.

FIG. 6 depicts a second connector embodiment generally indicated at 112. Connector 112 includes a base member 114 having first, second and third side portions 116, 118 and 119, respectively. As illustrated, first and second side portions 116 and 118 converge to define an angle $\theta_2$. In the preferred embodiment of connector 112, angle $\theta_2$ equals 108° C.

Figure 7A:
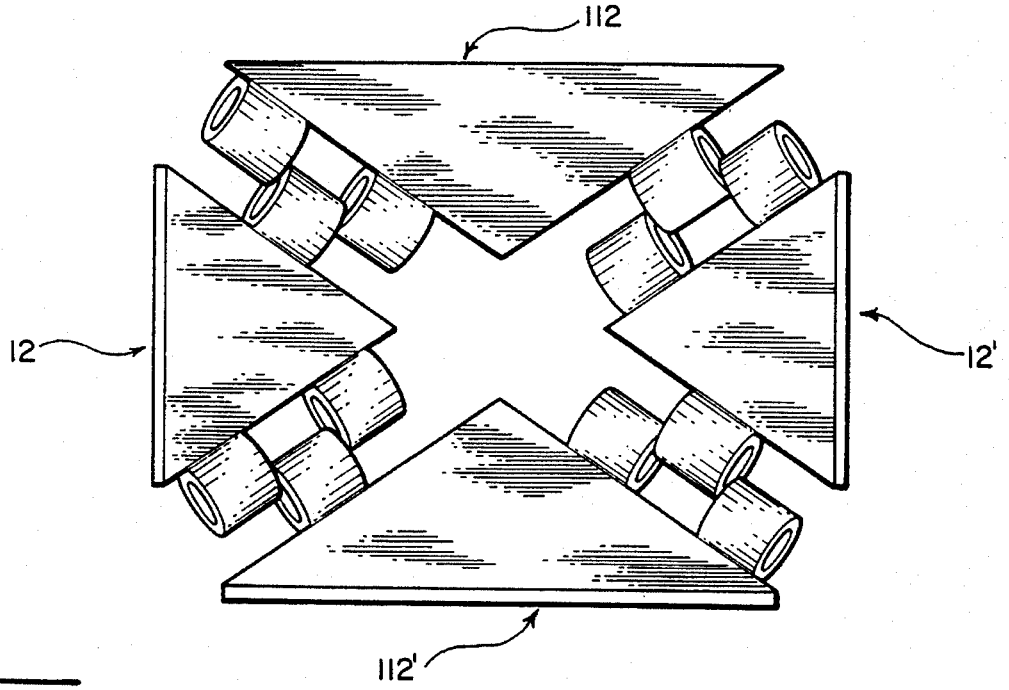
FIG. 7A is an exploded perspective view of four partially assembled, interlocking connectors using the connectors of FIGS. 1 and 6.
Figure 7B:
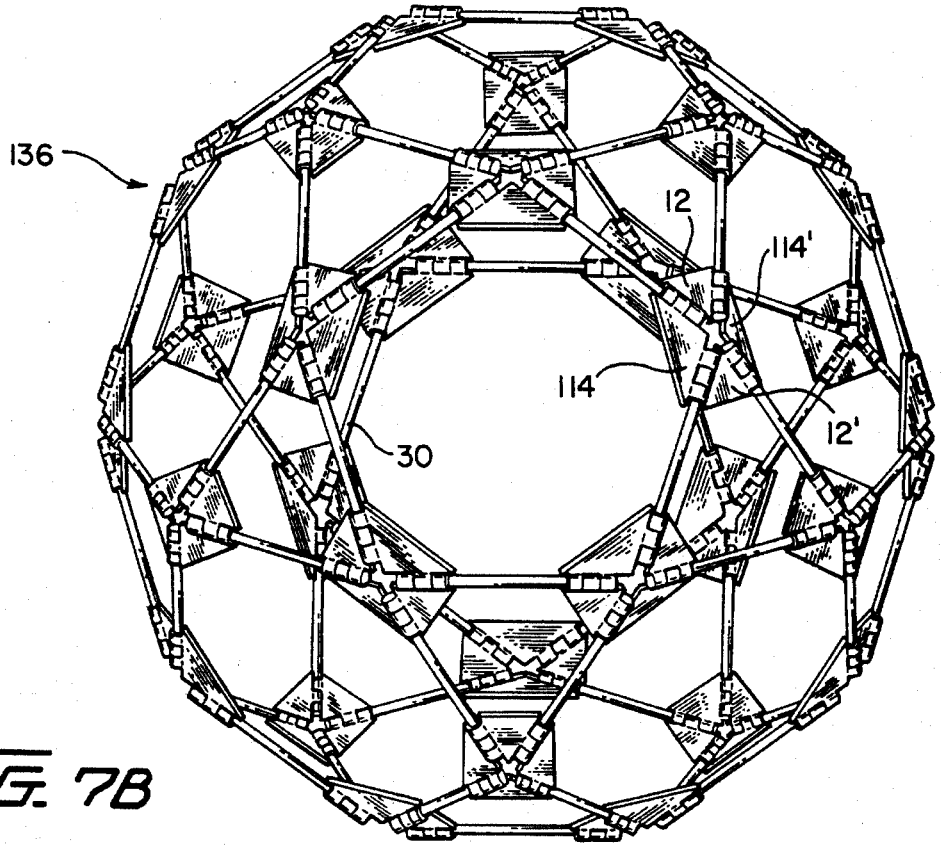
FIG. 7B is a perspective view of a 32-sided structure made using thirty of the connector assemblies depicted in FIG. 7A.

Secured to first side portion 116 is a first attaching element 124 having an associated first receiving opening 125. Second side portion 118 has attached thereto a pair of spaced attaching elements 126 and 128. Attaching elements 126 and 128 include respective receiving openings 127 and 129 which are axially aligned. As in the connector embodiment of FIG. 1, receiving opening 125 defines a longitudinal axis that intersects a longitudinal axis that extends through receiving openings 127 and 129 due to the convergence of side portions 116 and 118. Provided they are chosen to be of appropriate relative size, triangular connectors of the types depicted in FIG. 1 and 6 can satisfy the intersecting axes relationship discussed above. If so, two of each type can be joined together, in a manner analogous to that discussed with reference to FIG. 5A, to form a joint for joining four rods that have a single converging vertex as depicted in FIG. 7A. Thirty such joints and their associated rods can then be combined to form the 32-sided latticework structure 136 shown in FIG. 7B.

Figure 8:
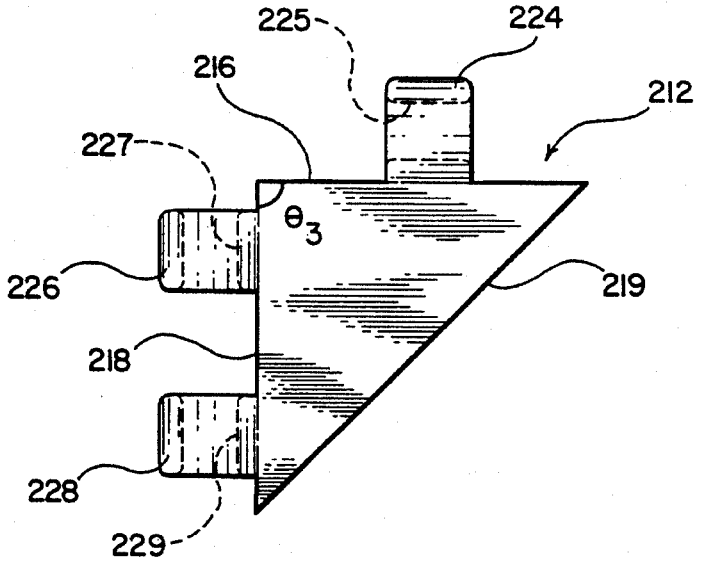
FIG. 8 is a plan view of a third connector embodiment according to the invention.
Figure 9:
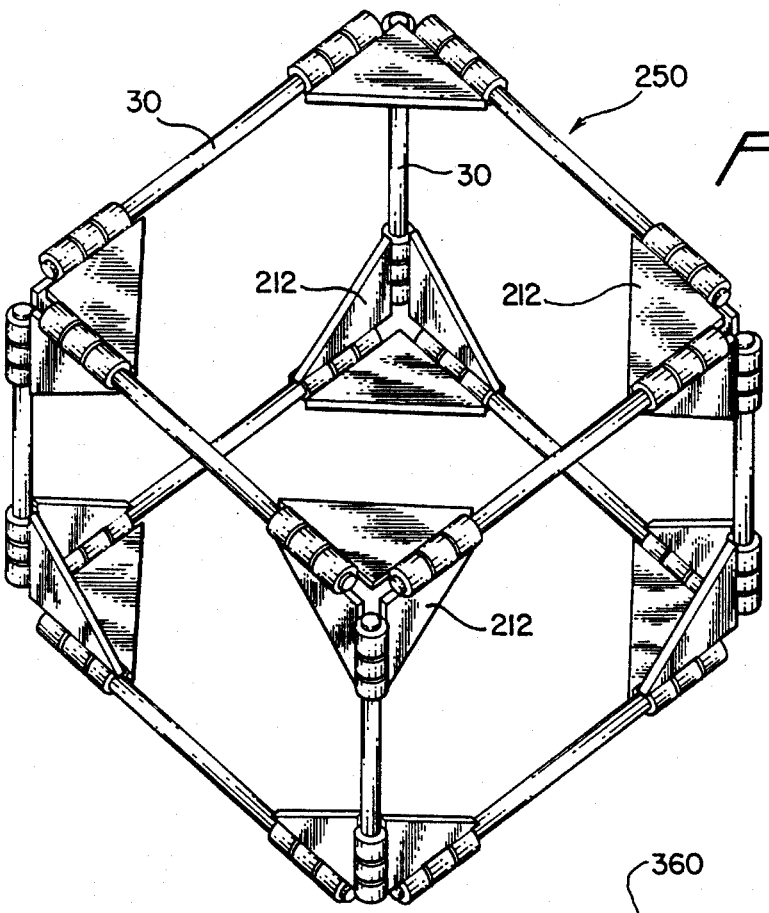
FIG. 9 is a perspective view of a cube made using the connectors of FIG. 8.

A third connector embodiment incorporated in the construction system of the present invention is depicted in FIG. 8 and referenced as 212. Connector 212 includes side portions 216, 218 and 219. Side portion 216 is provided with a first attaching element 224 having an associated receiving opening 225 that defines a longitudinal axis. In a similar manner, side portion 218 is provided with second and third, spaced attaching elements 226 and 228 having associated, axially aligned receiving openings 227 and 229 respectively. In this embodiment, side portions 216 and 218 converge to form an angle $\theta_3$ of 90° C. Of course, angle $\theta_3$ also equals the angle defined at the intersection of the longitudinal axes defined by receiving openings 225 and 227, 229 respectively. As shown in FIG. 9, various connectors 212, along with numerous rods 30, can be used to form a cube-shaped latticework structure generally indicated at 250.

Figure 10:
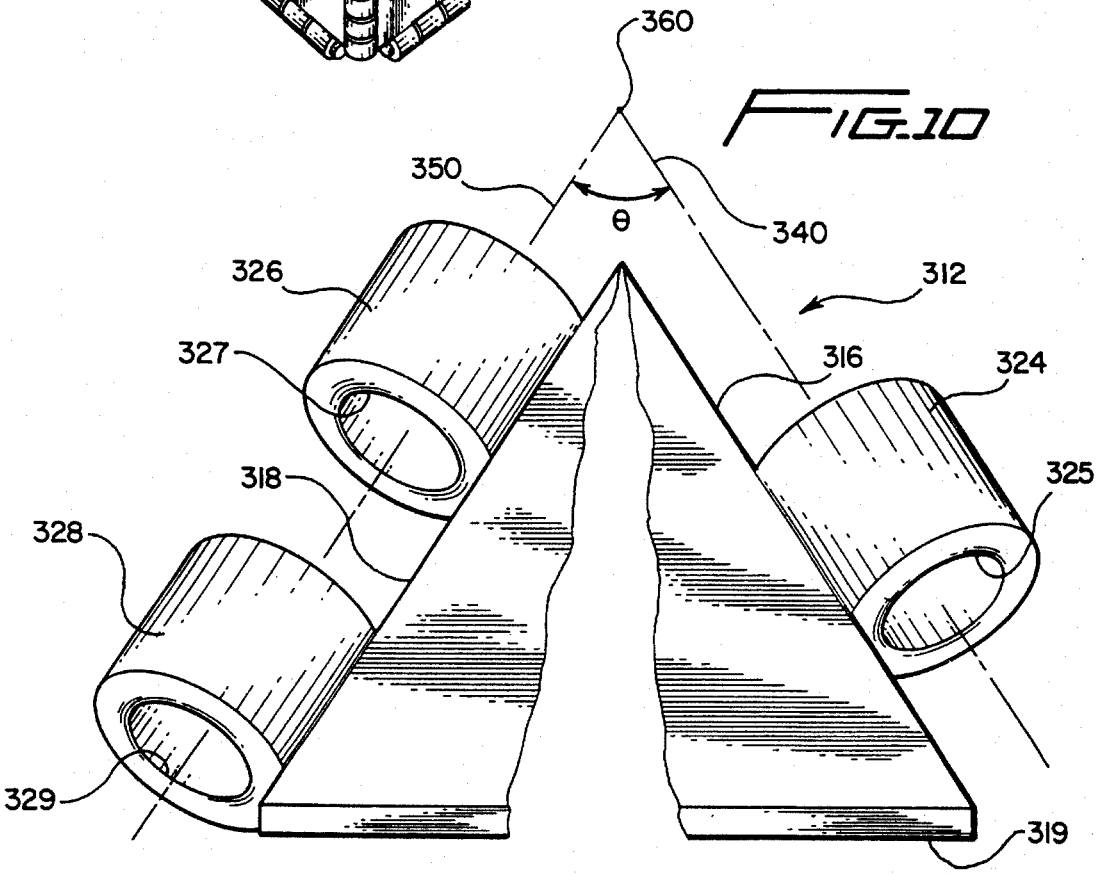
FIG. 10 is a partial perspective view illustrating a generic-type connector illustrating how the particular angle at the vertex of the converging axes of receiving openings associated with the attaching elements can be varied.

By this point, it should be apparent that the particular angle θ between the side portions of the connectors incorporated in the construction system of the invention can be varied without departing from the spirit of the invention. To illustrate this point, FIG. 10 is referenced as depicting a generic-type of connector 312 forming part of the construction system of the invention. As with the connector embodiments of FIGS. 1, 6 and 8, connector 312 includes side portions 316, 318 and 319 and attaching elements 324, 326 and 328. Attaching element 324 is provided along side portion 316 and attaching elements 326 and 328 are spaced along side portion 318. Receiving opening 325 associated with attaching element 324 has an associated longitudinal axis 340 that intersects a longitudinal axis 350 extending through aligned receiving openings 327 and 329 in attaching elements 326 and 328 respectively. Longitudinal axes 340 and 350 converge to a vertex 360 in space at a predetermined, wide ranging angle θ. Of course, it should be recognized that vertex 360 actually represents a permissible zone of intersection given manufacturing tolerances between the interconnected rods and connectors. Vertex 360 defines the same converging vertex for each connector used in a single joint regardless of the connector's predetermined angle, provided its size is chosen appropriately relative to the other connectors in the joint. This characteristic enables varying shaped connectors to be readily interconnected to form various latticework structures such as those depicted in FIGS. 5B, 7B and 9.

Figure 11:
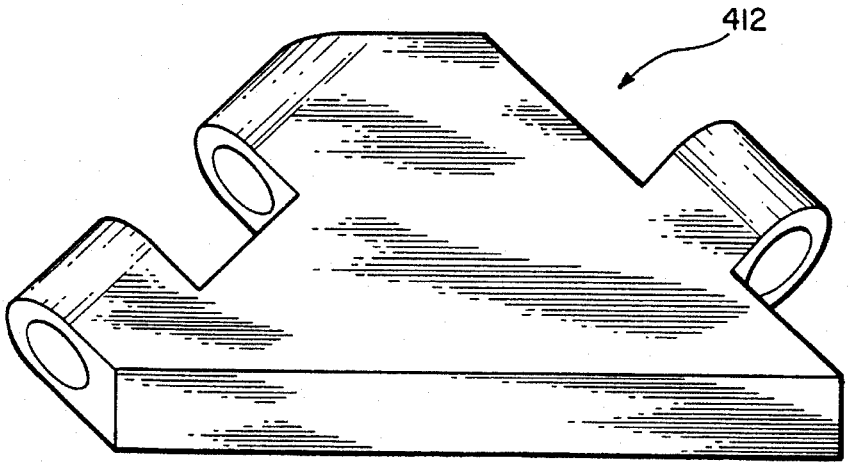
FIG. 11 shows a perspective view of a fourth, trapezoid-shaped connector embodiment with the attaching elements incorporated into the base plate.
Figure 12:
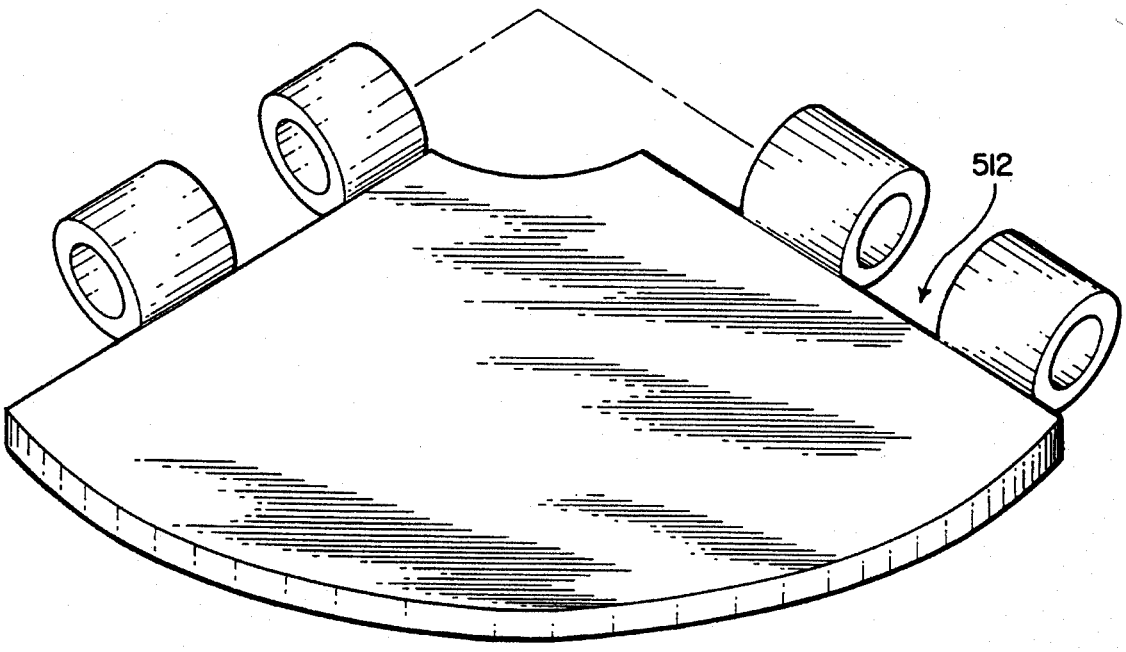
FIG. 12 shows a perspective view of a fifth, sector-shaped connector embodiment incorporating an additional attaching element.

So long as this criteria is met, connectors having a wide variety of shapes, sizes and predetermined angles associated therewith can be utilized and readily interconnected in accordance with the construction system of the present invention. Although connectors 12, 112 and 212 of FIGS. 1, 6 and 8 respectively have been depicted as triangular, various shaped connectors could be provided. For example, FIG. 11 depicts a connector 412 that is trapezoidal in shape and wherein the base portion has been thickened and the attaching members are integrally formed therewith, while FIG. 12 illustrates a connector 512 that defines a sector and has added a fourth attaching member, as might be desirable in applications requiring connectors of greater strength. In addition, in each of the drawings, the corresponding base member of each connector has been shown as having two straight side portions to which the attaching elements are secured. It must be kept in mind that these configurations are exemplary only. These members can be of practically any shape so long as they carry the required attaching elements and meet the desired intersecting criteria discussed above.

In the preferred embodiments discussed, the cross-section of each of the receiving openings of the attaching members have the same cross-section of the connecting rod placed through the openings. This need not be the case. The preferred embodiment of the construction system, as disclosed above, utilizes matching circular receiving openings and rods. This preferred arrangement aids in assembly of any given joint due to the permitted relative pivoting between the interconnected connectors. Of course, even with circular receiving openings and rods, once three connectors are interconnected, a substantially rigid joint is formed. However, if four or more connectors are assembled in this manner, relative pivoting will still be permitted. Of course, if relative pivoting were considered undesirable for a particular application, the receiving openings and rods can assume other polygonal cross-sections either over their entire lengths or simply at their associated connection locations.

Figure 13A:
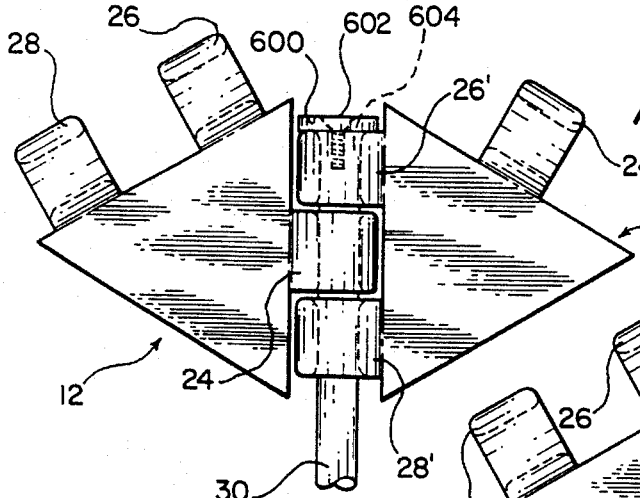
FIG. 13A is a plan view of a connector assembly similar to that shown in FIG. 4, further incorporating a retaining arrangement according to a first embodiment thereof.
Figure 13B:
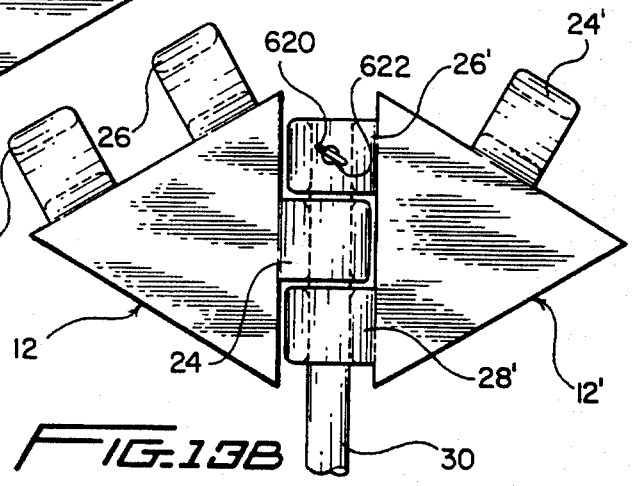
FIG. 13B is a plan view of a connector assembly similar to that shown in FIG. 4, further incorporating a retaining arrangement according to a second embodiment thereof.
Figure 13C:
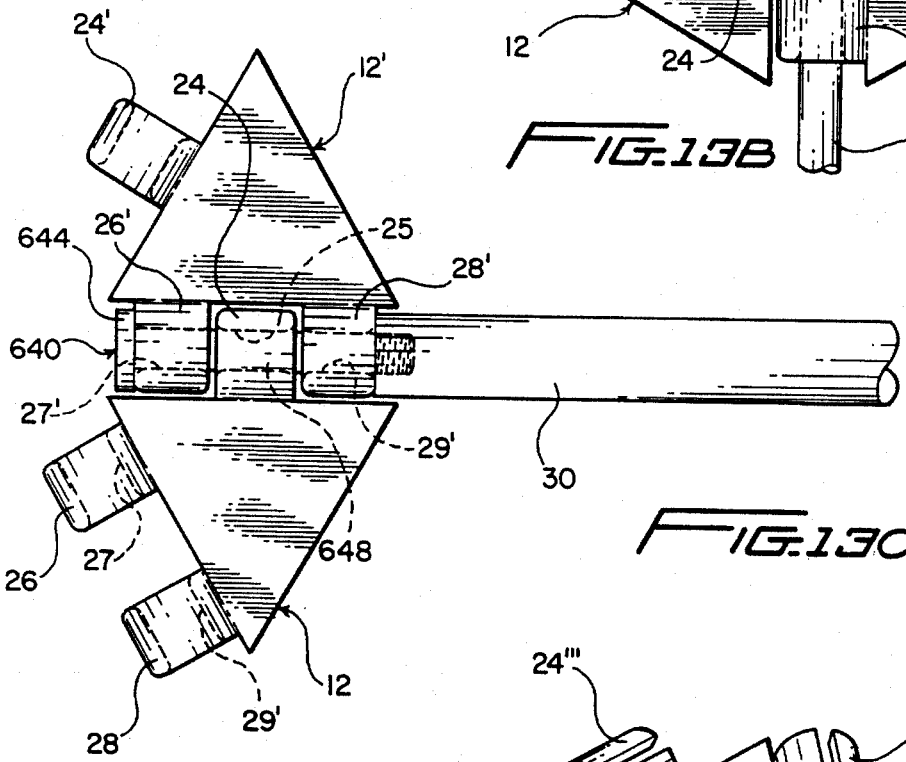
FIG. 13C is a plan view of a connector assembly similar to that shown in FIG. 4, further incorporating a retaining arrangement according to a third embodiment thereof.
Figure 13D:
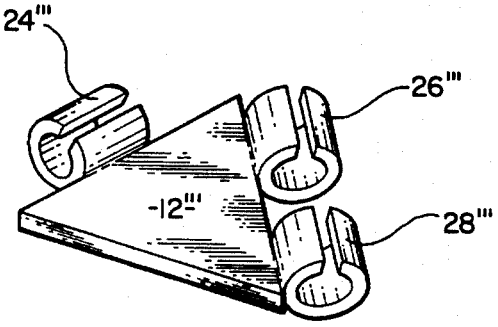
FIG. 13D is a perspective view of a connector similar to that shown in FIG. 1, further incorporating a retaining arrangement according to a fourth embodiment thereof.
Figure 13E:
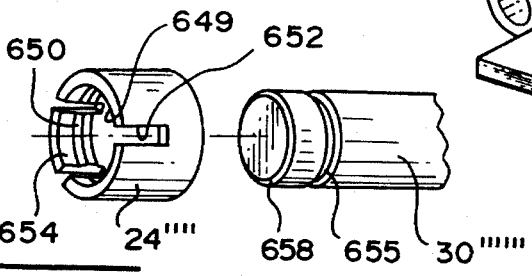
FIG. 13E is an exploded view of an attaching element that forms part of a retaining arrangement according to a fifth embodiment, along with an associated rod.

In some applications, it may be preferred to prevent one or more of the connectors from shifting in one or more axial directions relative to its respective connecting rod. For this purpose, a retaining assembly can be utilized. One preferred retaining assembly embodiment according to the invention is depicted in FIG. 13A. In FIG. 13A, a retaining assembly including an end cap 600, such as a washer, is secured, by means of a screw 602 or other known fastener, into one end 604 of a rod 30 traveling through the attaching elements 24, 26' and 28' of connectors 12 and 12'. Obviously, this retainer embodiment prevents uni-directional axially shifting of connectors 12 and 12' relative to rod 30. FIG. 13B depicts a second retainer embodiment in which a cotter pin 620 is placed through an aligned aperture 622 in attaching member 26' and rod 30 of connector 12'. This arrangement prevents bi-directional shifting of attaching elements 12 and 12' along rod 30. As a third exemplary embodiment, an additional retaining assembly embodiment is shown in FIG. 13C. In this embodiment, a bolt 640 is provided that includes a head portion 644 and a shank portion 648. Shank portion 648 has an associated diameter slightly less that the diameters of receiving openings 25, 27' and 29' and travels through the receiving openings 25, 27' and 29' of connectors 12 and 12∝ and then screws into rod 30, which in this embodiment has a diameter larger than that of receiving opening 29', while head portion 644 abuts attaching element 26'. Although not shown in this drawing, head portion 644 is preferably formed with a receiving opening for an hex-shaped key, a screwdriver or the like for tightening purposes. Of course, head portion 644 could also be shaped to receive a socket wrench or other fastening tool. This retainer arrangement not only prevents axial sliding of connectors 12 and 12' relative to rod 30, but shank portion 648 of bolt 640 defines an extension of rod 30. As a final exemplary embodiment, an additional retaining method is shown in FIG. 13D. According to this embodiment, all attaching elements 24''', 26''' and 28''' on connector 12''' are split and constructed of a resilient material while their corresponding receiving openings 25''', 27''' and 29''' have a common diameter slightly smaller than the associated diameter of a rod adapted to extend therethrough. Nonetheless, the rod can be inserted into receiving openings 25''', 27''' and 29''' by springing open the attaching elements 24''', 26''' and 28''' slightly along their respective splits. The rod will then be held in place by the frictional force supplied by its contact under pressure with the internal walls of the various attaching elements. According to the retainer arrangement depicted in FIG. 13E, one or more connectors can incorporate attaching elements 24'''' each of which includes a receiving opening 649. Integral with attaching element 24'''' and extending radially inwardly into receiving opening 649 is an annular flange 650. Attaching element 24'''' is also provided with a plurality of circumferentially spaced slits which extend longitudinally for a predetermined length of attaching element 24''''. According to the preferred embodiment depicted, three such circumferentially spaced slits 652 are provided which extend longitudinally through attaching element 24'''' as well as annular flange 650. With this construction, attaching element 24'''' defines a plurality of arcuate, resilient cantilevered portions 654. When attaching element 24'''' is used in combination with a rod 30''''' having an annular groove 655 that is spaced from a beveled terminal end 658, rod 30''''' can be inserted within receiving opening 649. As beveled end 658 engages annular flange 650, cantilevered portions 654 will deflect radially outwardly. As rod 30''''' is further inserted within receiving opening 649, annular flange 650 will be aligned with annular groove 655 and the resilient, cantilevered portions 654 will automatically deflect radially inwardly such that annular flange 650 will be maintained within annular groove 655 of rod 30''''' to frictionally maintain the connector associated with attaching element 24'''' at a predetermined longitudinal position along rod 30'''''. It should also be understood that there are many other possible methods of inducing friction between the rod and the inner walls of the attaching elements, including the use of adhesives.

Figure 14:
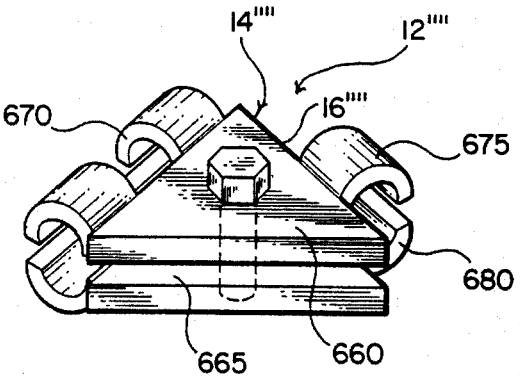
FIG. 14 depicts a fourth connector embodiment according to the present invention.

FIG. 14 depicts a still further connector 12'''' which can be utilized in the construction system of the invention. Connector 12'''' includes a split base portion 14'''' defined by two halves 660 and 665 which are interconnected by a suitable fastener 670, such as a bolt. Each half 660, 665 has secured on its associated side a segment of an overall attaching element. More specifically, by way of example, half 660 of connector 12'''' carries on side portion 16'''' an attaching segment 675. Attaching segment 675 defines an arcuate member which cooperates with a similarly constructed attaching segment 680 carried by half 665. According to this embodiment, connecting rods (not shown) may be placed between respective attaching segments and then bolt 670 may be threadably secured within half 665 in order to secure the rods in place by friction in a clamping arrangement.

Figure 15A:
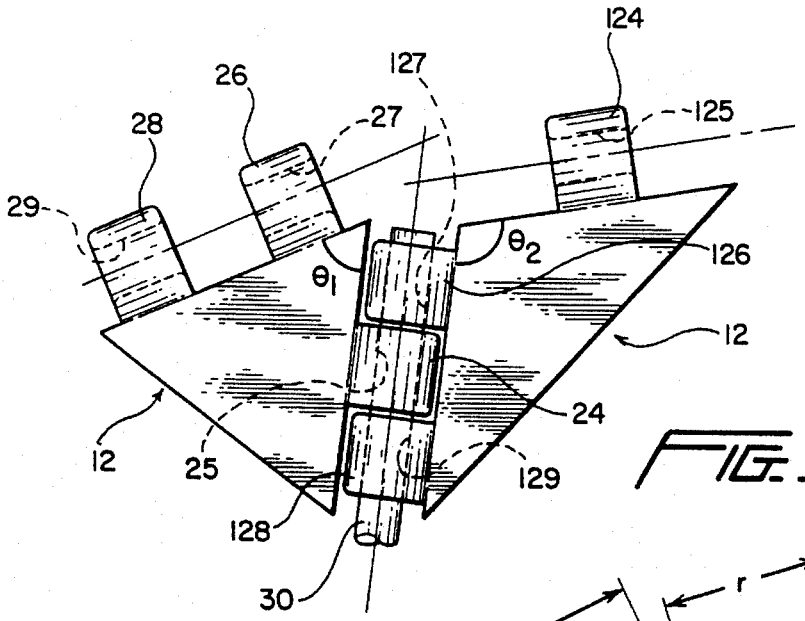
FIG. 15A is a plan view of two connectors, constructed in the manner shown in FIGS. 1 and 6, assembled together with a connecting rod.
Figure 15B:
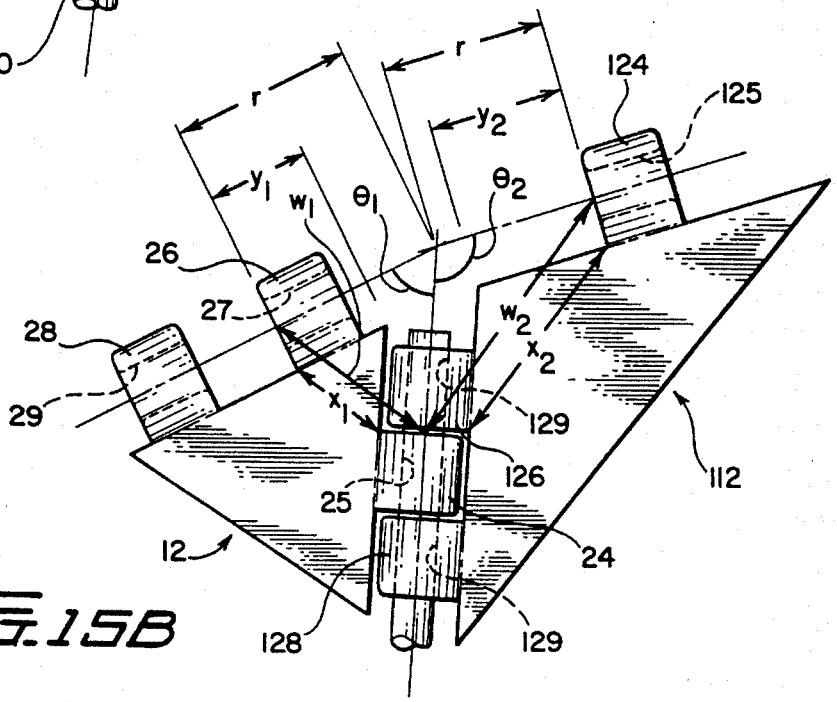
FIG. 15B is a plan view of two connectors, constructed in the manner shown in FIGS. 1 and 6, assembled together with a connecting rod as in FIG. 15A, but with different relative sizes of the connectors.

At this point, it should be emphasized that the relative dimensions of two joined connectors is important. FIGS. 15A and 15B are presented to illustrate that two connectors may or may not have intersecting axes when joined depending on their relative sizes. FIG. 15A shows a plan view of a connector 12 joined by a rod 30 to a connector 112. However, the intersection of the longitudinal axis defined by receiving openings 27 and 29 with the longitudinal axis defined by receiving openings 25, 127 and 129 is not coincident with the intersection of the longitudinal axis defined by receiving opening 125 with the longitudinal axis defined by receiving openings 25, 127 and 129. FIG. 15B is identical to FIG. 15A with the exception that the dimensions of connector 112 have been increased relative to those of connector 12 so that the intersections of the longitudinal axes are now coincident. Thus, for a plurality of connectors with different predetermined angles to fit together to form a joint with a unique converging vertex, their relative sizes must be chosen properly. In general, for any two connectors with mutually intersecting axes as illustrated in FIG. 15B, the following relationships exist:

$$\mathrm{Sin}\left(\frac{\theta_1}{2}\right)=\frac{\left(\frac{w_1}{2}\right)}{r}=\frac{\left(\frac{x_1}{2}\right)}{y_1} \text{ and}$$

$$\mathrm{Sin}\left(\frac{\theta_2}{2}\right)=\frac{\left(\frac{w_2}{2}\right)}{r}=\frac{\left(\frac{x_2}{2}\right)}{y_2};$$

$$w_1=2r\,\mathrm{Sin}\left(\frac{\theta_1}{2}\right) \text{ and } w_2=2r\,\mathrm{Sin}\left(\frac{\theta_2}{2}\right); \text{ and}$$

$$x_1=2y_1\mathrm{Sin}\left(\frac{\theta_1}{2}\right) \text{ and } x_2=2y_2\mathrm{Sin}\left(\frac{\theta_2}{2}\right).$$

$$S\sigma.\ w_2=\frac{w_1\mathrm{Sin}\left(\frac{\theta_2}{2}\right)}{\mathrm{Sin}\left(\frac{\theta_1}{2}\right)} \text{ and } \frac{w_1y_1}{x_1}=\frac{w_2y_2}{x_2}.$$

Therefore, given various predetermined parameters associated with each connector, the remaining required values can be readily determined so that the joined connector can be properly, relatively sized.

Figure 16:
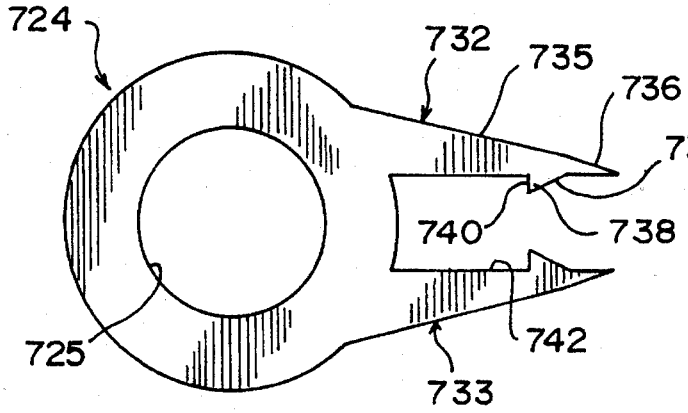
FIG. 16 is a side view of a removable attaching element provided in accordance with another embodiment of the present invention.
Figure 17:
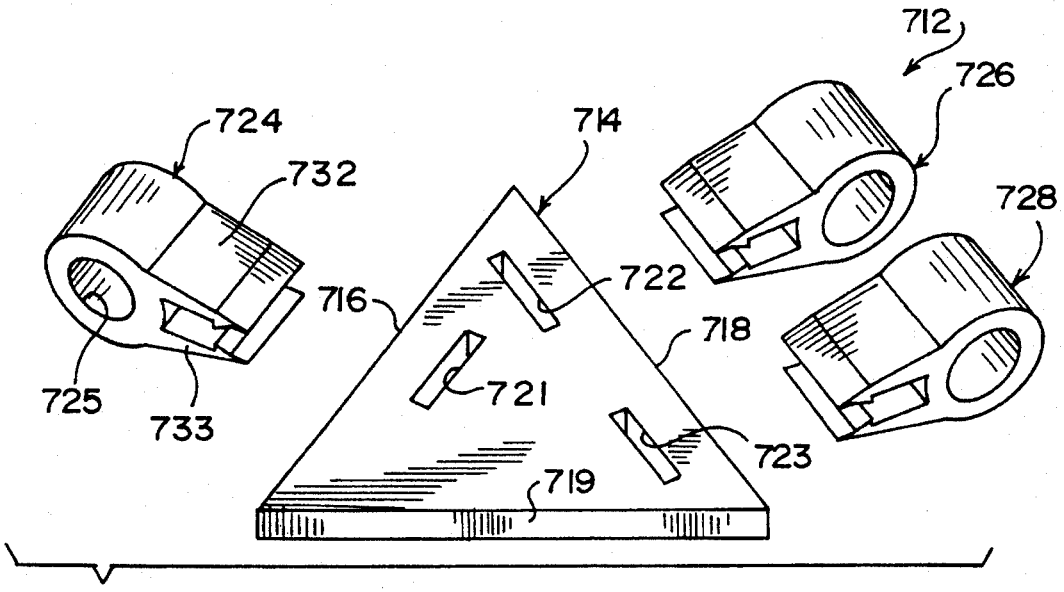
FIG. 17 is an exploded view of another connector arrangement for use in the construction system of the present invention that incorporates various attaching elements as illustrated in FIG. 16.
Figure 18:
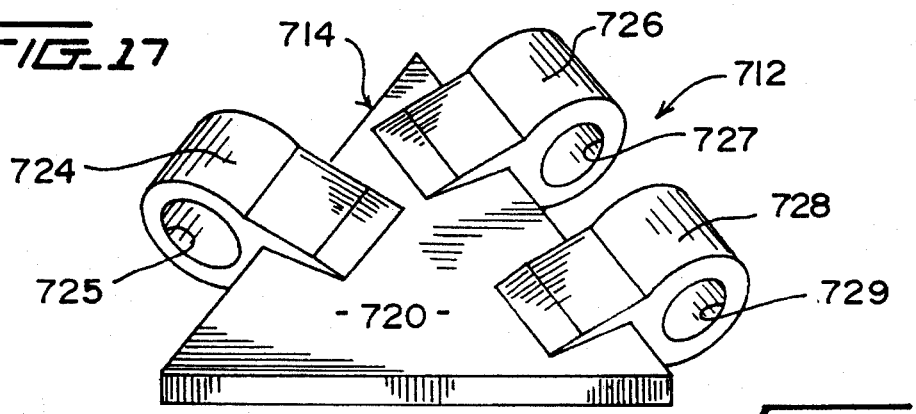
FIG. 18 is an assembled view of the connector illustrated in FIG. 17.

Reference will now be made to FIGS. 16–18 in describing another embodiment for the connectors incorporated in the construction system of the present invention. These figures illustrate a connector 712 that comprises a base portion 714 having a first side 716, a second side 718 and a third side 719. In the embodiment depicted in these figures, first and second sides 716 and 718 converge to define an angle equaling 60° C. Of course, this is only an exemplary embodiment for connector 712 and base portion 714 can take various polygonal shapes with a variety of vertex angles in a manner similar to the connectors described above.

The upper face 720 of base portion 714 is shown in these figures with a plurality of slots 721–723 formed therein. More specifically, a slot 721 is formed adjacent side 716 and a pair of spaced slots 722,723 are provided adjacent side 718. In the preferred embodiment, slot 721 extends generally parallel to side 716 and slots 722 and 723 extend generally parallel to side 718. As best illustrated in the assembled view depicted in FIG. 18, a first attaching element 724 is to be secured to first side 716 of base portion 714. In the preferred embodiment shown, attaching element 724 is preferably formed with a receiving opening 725 that is circular in cross-section, however, it is to be understood that varying cross-sections can be incorporated in a manner analogous to that discussed heretobefore. A second attaching element 726 having a receiving opening 727 and a third attaching element 728 having a receiving opening 729 are adapted to be secured along side 718 of base portion 714. As indicated above, each of the attaching elements 724, 726 and 728 cooperate with a respective slot 721–723 for connecting the respective attaching element to base portion 714. The specific manner in which these attaching elements are secured to base portion 714 will now be described in detail.

Since each of the attaching elements 724, 726 and 728 are constructed in an identical fashion, the specific construction of attaching element 724 will now be described in detail and it is to be understood that the other attaching elements have corresponding structure. As best illustrated in FIG. 16, attaching element 724 constitutes a tubular member from which a pair of spaced clip members 732 and 733 project. Each clip member 732, 733 includes a first sloping section 735 extending away from the tubular portion of attaching element 724 and a terminal sloping section 736. Located inwardly of terminal sloping section 736 is a tab 738. The tab 738 provided on each clip member 732, 733 projects toward the other clip member as clearly illustrated in FIG. 16. Each tab 738 includes a surface 739 which slopes generally away from terminal sloping section 736 and an abutting surface 740 arranged at an acute angle to sloping surface 739.

With this arrangement, a cavity 742 is defined between clip members 732 and 733. This cavity 742 is dimensioned slightly greater than the thickness of connector 712 such that, for example, attaching element 724 can be positioned at first side 716 and pushed about base portion 714 such that a section of base portion 714, between first side 716 and slot 721 is received within cavity 742. Once this section of base portion 714 is received within cavity 742, tab 738 will deflect inwardly and be received within slot 721. Therefore, it should be readily apparent that clip members 732 and 733 are somewhat resilient in order to permit the clip members 732 and 733 to deflect away from each other upon initial placement about base portion 714 and then to retract toward each other in order that tab 738 will be retained within slot 721 by means of the cooperation between abutting surfaces 740 and slot 721.

This arrangement of providing removable attaching elements to connectors constructed in accordance with the present invention allows more flexibility in the manufacture of the parts of the present construction system and also adds to the versatility of the system. With such an arrangement, a common connector 712 can be utilized with various rods, such as those described above with reference to numbers 30, 32 and 34, by simply securing different attaching elements to the connector 712. Providing the first sloping section 735 and terminal sloping section 736 enable clip members 732 and 733 to maintain their structural integrity while also enabling the clip members 732 and 733 to provide a smooth transition to the base portion 714 of connector 712 such as the smooth transition illustrated in FIG. 18 with respect to upper face 720. In other words, clip members 732 and 733, when secured to base portion 714, taper down to upper face 720. At this point, it should be noted that, although a preferred embodiment of the manner of removably securing attaching elements 724, 726 and 728 to base portion 714 has been described, various other types of removable connecting arrangements known in the art can also be utilized without departing from the spirit of the invention.

Figure 19:
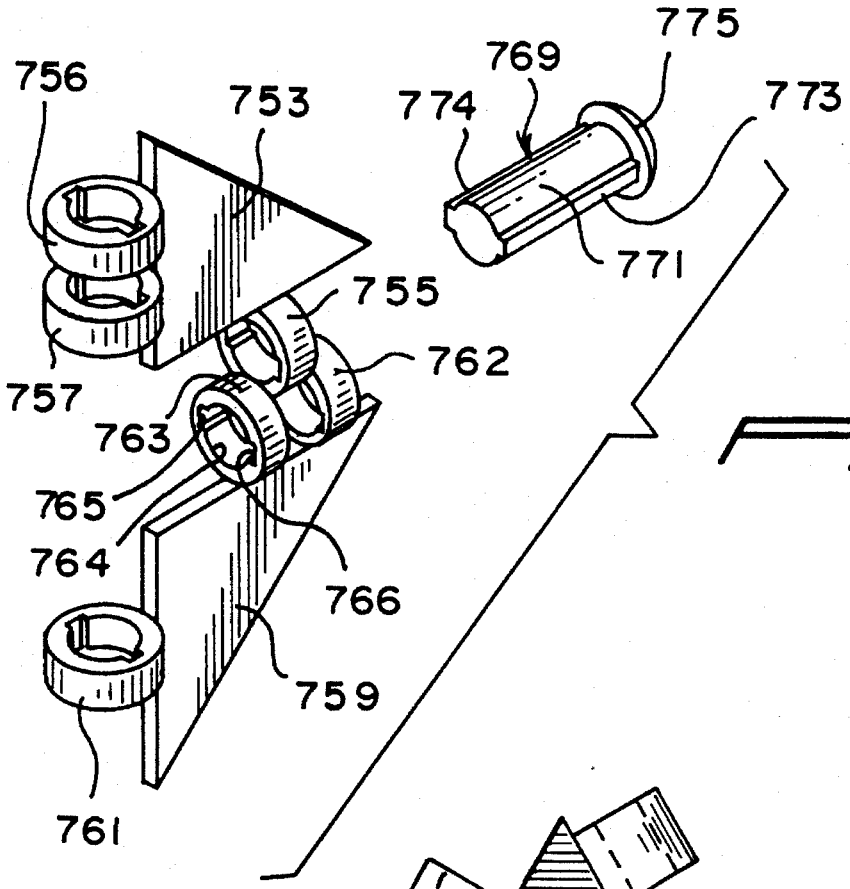
FIG. 19 illustrates a connector assembly in accordance with a still further aspect of the invention.

In order to enable two or more connectors to be joined together so as to function as a single connector in accordance with the present invention, it is proposed to provide an arrangement for interconnecting connectors without the need for a rod. FIG. 19 illustrates a preferred embodiment of this aspect of the invention and depicts a connector 753 having attaching elements 755–757 and a connector 759 having attaching elements 761–763. These various attaching elements can be secured to their respective connection members in a manner generally analogous to any of the embodiments described above, however, the specific design of the attaching elements has been altered in the manner described fully below. Since the structure of each of the attaching elements 755–757 and 761–763 are identical, the particular structure of only one attaching element 763 will be described and it is to be understood that all of the other attaching elements are similarly constructed.

Attaching element 763 includes a receiving opening 764 that is formed with at least one longitudinally extending groove 765. In the preferred embodiment, a pair of opposed longitudinally extending grooves 765 and 766 are actually provided. According to this aspect of the invention, a plug member 769 is also provided. Plug member 769 includes a shank portion 771 that is preferably formed with opposed, longitudinally extending flanges 773 and 774, as well as a head or cap portion 775. With this arrangement, connectors 753 and 759 can be joined, for example, by aligning the respective receiving openings in attaching elements 762, 755 and 763, as well as the respective longitudinally extending grooves provided in these elements, and inserting plug member 769 through these aligned receiving openings. In doing so, longitudinally extending flanges 773 and 774 will be received within the aligned longitudinally extending grooves such that connector 753 will be rigidly joined with connector 759. This combined connector can then be used in combination with another connector to form a joint which receives a rod in forming a latticework structure. Again, it should be recognized that connectors 753 and 759 can be interconnected to function as a single connector in accordance with the present invention by various methods. For example, the attaching elements need not be provided with longitudinally extending grooves if the receiving openings are polygonal in shape. It is only important in accordance with the present invention to note that the two connectors become rigidly connected so that they function as a single connector. Joining connectors in this fashion allows small connectors to function in tandem as larger ones. For example, two 60° connectors can be combined to function as a 120° connector, a 90° connector and a 45° C. connector can be combined to function as a 135° connector, etc. Following such an approach enables a limited set of connectors to, in effect, be expanded to a set of connectors having a greater range of flexibility in order to construct a large variety of latticeworks that vary in size and shape.

Reference will now be made to FIGS. 20–23 in describing attachment elements that can be incorporated into the construction system of the present invention. FIG. 20 depicts a latticework 785 constructed using connectors and rods in the manner set forth above. These figures illustrates a feature of the present invention wherein additional members can be attached to the open latticework 785 in order to provide coverings, facings and/or bases. For instance, in accordance with the present invention, a sleeve member shown at 789 in FIG. 21A can be provided about a rod 30 such that sleeve member 789 will be positioned between a set of longitudinally spaced groups of connectors that are interconnected by rod 30. Sleeve member 789 can be positioned in this fashion by inserting rod 30 therethrough or by separately attaching sleeve member 789, such as by conventional attaching means such as those sold under the trademark VELCRO or the like, about rod 30. As depicted, sleeve member 789 incorporates a longitudinally extending flap 791. Sleeve member 789 and flap 791 are preferably made of a fabric material or cloth but could be formed of plastic or the like as well. Flap 791 includes a longitudinally extending terminal end 793 to which is secured a fastening member 795. In the preferred embodiment of the invention, fastening member 795 constitutes a zipper element but other fastening arrangements could be provided within the scope of the present invention including hook and loop-type fasteners generally sold under the trademark VELCRO.

If a facing or cover is to be provided at one side of latticework 785, then sleeve member 789 will be used to perform this function, however, if it is desired to provide cover members over adjacent latticework areas, a sleeve member 789' having a first flap 791' and a second flap 798 arranged at an angle to first flap 791' can be provided as shown in FIG. 21B. In either case, these sleeve members are adapted to cooperate with one or more cover members 803 which are preferably formed of fabric. Cover member 803 can take various geometric shapes depending upon the shape of the latticework constructed, but in the embodiment depicted in FIGS. 20 and 21B, is generally triangular and includes side portions 806–808, each of which have secured thereto fastening members 810–812. Fastening members 810–812 cooperate with a respective one of fastening members 795, 795' in order to attach a respective side 806–808 along a respective rod 30. With three such sleeve members and cooperate fastening members being provided, cover member 803 can be secured to cover a face of latticework 785 in the manner shown in FIG. 20. Obviously, cover member 803 can also be readily removed. To accommodate the connectors used to form latticework 785, cover member 803 is preferably formed with trimmed corner sections 815–817.

Figure 22:
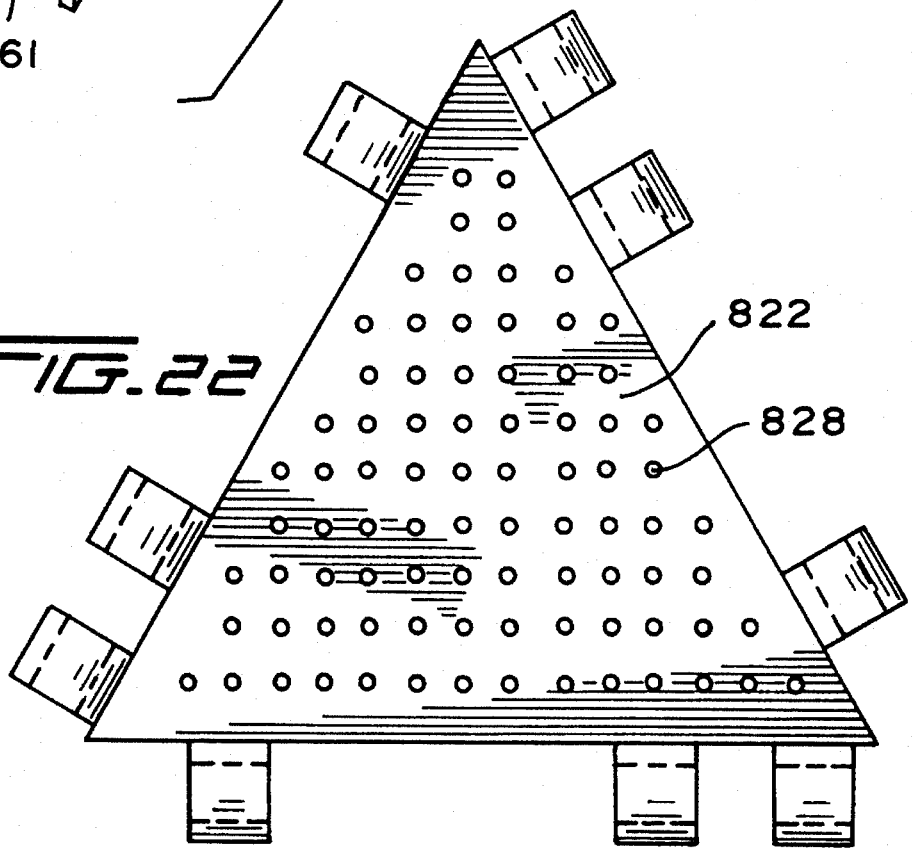
FIG. 22 is a plan view of a rigid body member that can be integrated into a latticework structure assembled with the construction set of the present invention in order to enable auxiliary construction blocks to be attached to the latticework.

As indicated above, it is also an aspect of the present invention to provide a base or flooring for use as an auxiliary attachment to a constructed latticework. An exemplary base defined by a rigid body portion 822 that is preferably formed of plastic is shown in FIGS. 20 and 22. In a manner directly analogous to the attaching structure described above for the various connectors, rigid body portion 822 can be provided with a plurality of attaching elements along the sides thereof. When the attaching elements are arranged in the manner shown in FIG. 22 with the attaching elements being located adjacent corners of the body portion 822, the base can also function as a connector and be used in combination with various other connectors as described above to form a latticework such as that depicted in FIG. 20. On the other hand, rigid body portion 822 can be provided with one or more attaching elements adjacent a central section of its sides so that rigid body portion 822 can be supported by a plurality of rods 30 in a manner directly analogous to that described above with respect to sleeve members 789 and 789'

In either case, rigid body portion 822 is preferably formed with a plurality of upstanding and spaced pegs 828. Upstanding pegs 828 are configured such that conventional construction blocks, such as those commonly sold under the trademarks LEGO and DUPLO, can be mounted thereon. Providing rigid body portion 822 with upstanding pegs 828 in this fashion greatly adds to the versatility of the construction system of the present invention.

Figure 23:
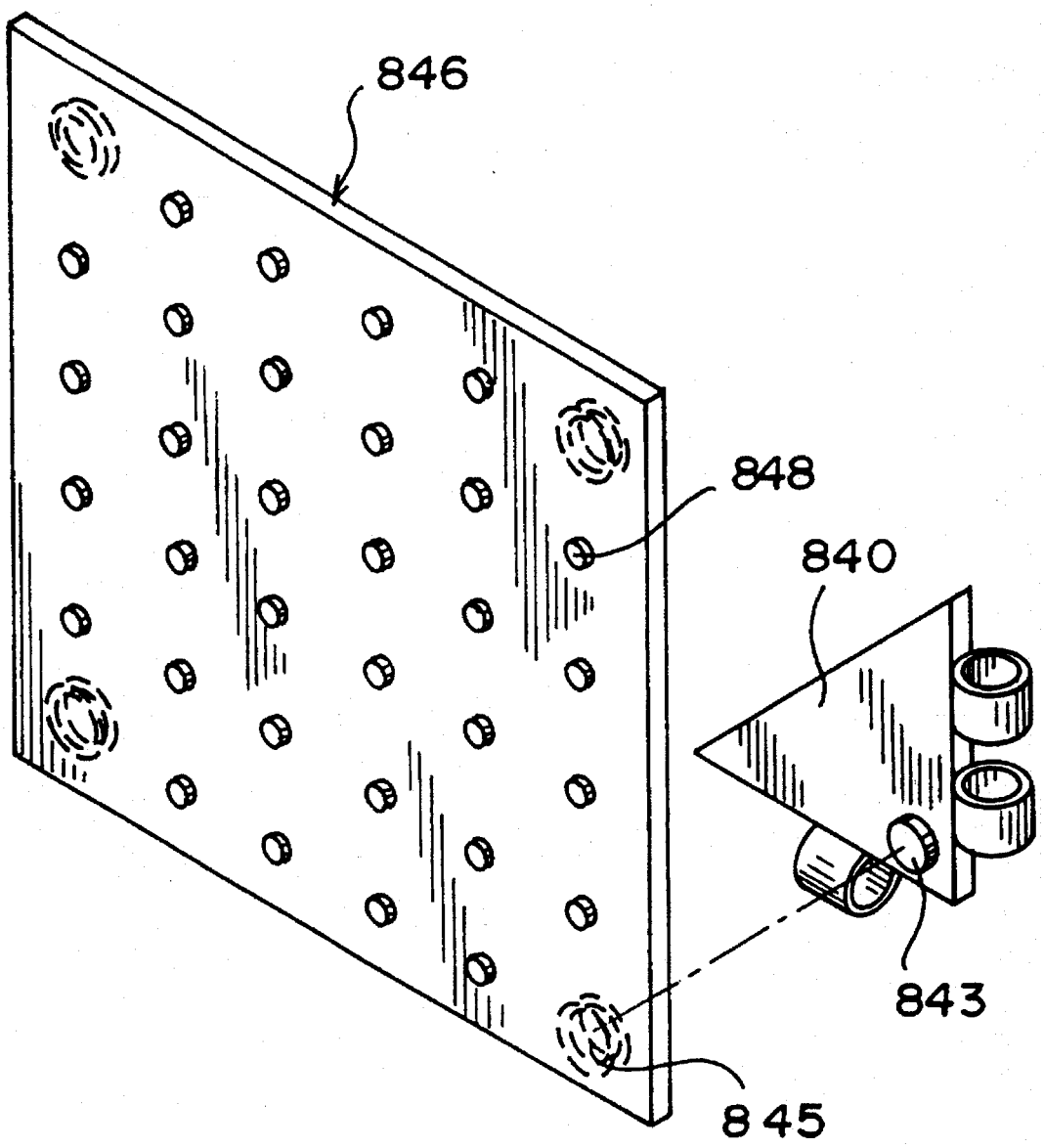
FIG. 23 illustrates another manner in which a rigid body member for use in connection with auxiliary construction blocks to be used with a latticework made in accordance with the present invention.

It should be noted that the facings or bases incorporated in latticeworks constructed in accordance with the present invention can be shaped and configured in various different ways. In addition, various other types of connection arrangements can also be utilized without departing from the spirit of the invention. FIG. 23 illustrates another preferred embodiment wherein a connector 840 constructed in a substantially identical manner to the connectors described heretobefore is further provided with a protruding post member 843. The protruding post 843 is adapted to be received within a corresponding connection recess 845 provided in a cover member 846. Each recess 845 may extend partially into or entirely through cover member 846. In this embodiment, cover member 846 is preferably formed of a substantially rigid material such as plastic and is also provided with a plurality of upstanding pegs 848 for using conventionally known building blocks in combination with latticeworks constructed in accordance with the present invention. With the embodiment shown in FIG. 23, similar connectors 840 would be utilized in the latticework structure such that cover member 846 would be supported at various locations, such as at each of the corners of cover member 846.

The versatility of the construction system of the present invention should be readily apparent to one of ordinary skill in the art. Obviously, a given set of connectors with only a relatively small range of angles can be used to make an abundance of varying shaped latticework structures. For example, a set of only seven distinctly shaped connectors having angles of 36°, 45°, 54°, 60°, 72°, 90° and 108° respectively, can be used to construct six different triangles, i.e., 60°/60°/60°,45°/45°/90°, 36°/36°/108°, 36°/54°/90°, 54°/54°/72°, and 36°/72°/72° triangles, eight different quadrilaterals, i.e., 108°/108°/108°/36°, 108°/108°/54°/90°, 108°/54°/108°/90°, 108°/108°/72°/72°, 108°/72 °/108 °/72 °, 90°/108°/72°/90°, 90°/108°/90°/72° and 90°/90°/90°/90° quadrilaterals, and a pentagon, i.e., a 108°/108°/108°/108° pentagon. In addition, if the connectors are constructed in the manner set forth above with reference to FIG. 19, the set of seven connectors could, in effect, be expanded to a set of 25 distinct connectors, i.e., 36°, 45°, 54°, 60°, 72°, 81°, 90°, 96°, 99°, 105°, 108°, 114°, 117°, 120°, 126°, 132°, 135°, 144°, 150°, 153°, 162°, 168°, 180°, 198° and 216°. Obviously these 25 connectors could, in turn, be combined with one another to form dozens of distinct quadrilaterals, pentagons, hexagons, etc. in a large variety of shapes and sizes. Therefore, with a relatively few number of distinct parts, the construction system of the present invention can be used to make an abundance of differing latticework structures.

While the present invention has been described with reference to preferred embodiments thereof, it is to be understood that various changes and/or modifications can be made without departing from the spirit of the invention. In general, the invention is only intended to be limited by the scope of the following claims.

I claim:

1. A construction system for making latticework structures comprising:

a plurality of connectors, each of said connectors including a base portion, having opposing faces and at least first, second and third side portions, and a plurality of attaching elements, said plurality of attaching elements including a first attaching element mounted on the first side portion of said base portion and a second attaching element mounted on the second side portion of said base portion, said first and second attaching elements respectively including first and second receiving openings each of which has an associated longitudinal axis, the longitudinal axis of said first receiving opening intersecting the longitudinal axis of said second receiving opening at a predetermined angle;

a plurality of rods, each of said rods including first and second longitudinally spaced end portions, a first group of said plurality of connectors being interconnected by aligning the first receiving opening of a first connector of said first group of connectors with the second receiving opening of another connector of said first group of connectors and inserting the first end portion of a respective one of said plurality of rods within the aligned receiving openings to interconnect the first group of connectors, wherein a plurality of groups of said plurality of connectors are interconnectable, in a manner commensurate with said first group of connectors, at respective longitudinally spaced end portions of respective ones of said plurality of rods so as to collectively form an open latticework structure; and means for retaining the first end portion of said respective one of said plurality of rods within said aligned receiving openings, wherein said means for retaining comprises an annular flange of said first attaching element that projects radially inwardly into said first receiving opening and the first end portion of said one of said plurality of rods is formed with an annular groove at a position spaced from a terminal end of said first end portion, said annular flange being receivable within said annular groove.

2. A construction system according to claim 1, wherein said first attaching element further includes a plurality of circumferentially spaced and longitudinally extending slits such that said first attaching element defines a plurality of resilient, cantilevered portions, said annular flange being provided on said cantilevered portions.

3. A construction system according to claim 1, further comprising face forming means attached to respective ones of said plurality of rods at locations spaced from the first and second longitudinally spaced end portions of said respective ones of said plurality of rods.

4. A construction system according to claim 3, wherein said face forming means comprises a plurality of sleeve members which extend about said respective ones of said plurality of rods and a cover member extending between and attached to said plurality of sleeve members.

5. A construction system according to claim 4, further comprising means for releasably securing said cover member to said plurality of sleeve members.

6. A construction system for making latticework structures comprising:

a plurality of connectors, each of said connectors including a base portion, having opposing faces and at least first, second and third side portions, and a plurality of attaching elements, said plurality of attaching elements including a first attaching element mounted on the first side portion of said base portion and a second attaching element mounted on the second side portion of said base portion, said first and second attaching elements respectively including first and second receiving openings each of which has an associated longitudinal axis, the longitudinal axis of said first receiving opening intersecting the longitudinal axis of said second receiving opening at a predetermined angle;

a plurality of rods, each of said rods including first and second longitudinally spaced end portions, a first group of said plurality of connectors being interconnected by aligning the first receiving opening of a first connector of said first group of connectors with the second receiving opening of another connector of said first group of connectors and inserting the first end portion of a respective one of said plurality of rods within the aligned receiving openings to interconnect the first group of connectors, wherein a plurality of groups of said plurality of connectors are interconnectable, in a manner commensurate with said first group of connectors, at respective longitudinally spaced end portions of respective ones of said plurality of rods so as to collectively form an open latticework structure; and means for readily removably securing said attaching elements to respective ones of said plurality of connectors.

7. A construction system according to claim 6, wherein said securing means comprises clips carried by said plurality of attaching elements which are adapted to be secured within respective slots provided in said respective ones of said plurality of connectors.

8. A construction system according to claim 6, further comprising face forming means attached to respective ones of said plurality of rods at locations spaced from the first and second longitudinally spaced end portions of said respective ones of said plurality of rods.

9. A construction system according to claim 8, wherein said face forming means comprises a plurality of sleeve members which extend about said respective ones of said plurality of rods and a cover member extending between and attached to said plurality of sleeve members.

10. A construction system according to claim 9, further comprising means for releasably securing said cover member to said plurality of sleeve members.

11. A construction system for making latticework structures comprising:

a plurality of connectors, each of said connectors including a base portion, having opposing faces and at least first, second and third side portions, and a plurality of attaching elements, said plurality of attaching elements including a first attaching element mounted on the first side portion of said base portion and a second attaching element mounted on the second side portion of said base portion, said first and second attaching elements respectively including first and second receiving openings each of which has an associated longitudinal axis, the longitudinal axis of said first receiving opening intersecting the longitudinal axis of said second receiving opening at a predetermined angle;

a plurality of rods, each of said rods including first and second longitudinally spaced end portions, a first group of said plurality of connectors being interconnected by aligning the first receiving opening of a first connector of said first group of connectors with the second receiving opening of another connector of said first group of connectors and inserting the first end portion of a respective one of said plurality of rods within the aligned receiving openings to interconnect the first group of connectors, wherein a plurality of groups of said plurality of connectors are interconnectable, in a manner commensurate with said first group of connectors, at respective longitudinally spaced end portions of respective ones of said plurality of rods so as to collectively form an open latticework structure; and a base member interengaged between a set of said plurality of rods, said base member including a rigid body portion formed with a plurality of spaced, upstanding pegs.

12. A construction system according to claim 11, wherein said base member carries a plurality of attaching elements which slidably receive respective ones of said set of said plurality of rods.

13. A construction system according to claim 11, wherein selected ones of said plurality of connectors incorporate an upstanding post, said base member being formed with a recess for removably receiving said upstanding post to secure said base member to said selected ones of said plurality of connectors.

* * * * *